US009686600B2

(12) United States Patent
Chien

(10) Patent No.: US 9,686,600 B2
(45) **Date of Patent: *Jun. 20, 2017**

(54) AUDIO OUTPUT DEVICE AND VIDEO/AUDIO OUTPUT DEVICE USING THE SAME

(71) Applicant: AmTRAN TECHNOLOGY CO., LTD, New Taipei (TW)

(72) Inventor: Jung-Hsin Chien, New Taipei (TW)

(73) Assignee: AMTRAN TECHNOLOGY CO., LTD., New Taipei (TW)

( * ) Notice: Subject to any disclaimer, the term of this patent is extended or adjusted under 35 U.S.C. 154(b) by 220 days.

This patent is subject to a terminal disclaimer.

(21) Appl. No.: 14/580,034

(22) Filed: Dec. 22, 2014

(65) Prior Publication Data

US 2015/0104051 A1 Apr. 16, 2015

Related U.S. Application Data

(63) Continuation of application No. 13/791,405, filed on Mar. 8, 2013, now Pat. No. 8,953,832.

(30) Foreign Application Priority Data

Nov. 23, 2012 (TW) ..... 101144049

(51) Int. Cl.

| | |
|---|---|
| ***H04R 5/02*** | (2006.01) |
| ***H04R 1/02*** | (2006.01) |
| *H04R 1/26* | (2006.01) |
| *H04R 1/34* | (2006.01) |

(52) U.S. Cl.

CPC ..... *H04R 1/028* (2013.01); *H04R 1/02* (2013.01); *H04R 1/025* (2013.01); *H04R 5/02* (2013.01); *H04R 1/26* (2013.01); *H04R 1/345* (2013.01); *H04R 2205/024* (2013.01); *H04R 2499/15* (2013.01)

(58) Field of Classification Search

CPC ..... H04M 1/035; H04R 2499/11; H04R 2499/15; H04R 5/02; F16M 11/12

USPC ..... 381/385–388, 333–334, 306

See application file for complete search history.

(56) References Cited

U.S. PATENT DOCUMENTS

| | | | |
|---|---|---|---|
| 5,657,392 | A | 8/1997 | Bouchard |
| 5,898,137 | A | 4/1999 | Saito |

(Continued)

FOREIGN PATENT DOCUMENTS

| | | | |
|---|---|---|---|
| CN | 1158535 | A | 9/1997 |
| CN | 101023703 | A | 8/2007 |

OTHER PUBLICATIONS

CN Office Action dated Sep. 7, 2016 as received in Application No. 201510023171.0.

*Primary Examiner* — George Monikang
(74) *Attorney, Agent, or Firm* — Maschoff Brennan

(57) ABSTRACT

An audio output device including a casing, a first speaker component, a second speaker component and a sound-guiding board, and a video/audio output device using the same are disclosed. The first speaker component is a circular speaker, and is disposed at the casing. The first speaker component faces towards a first direction. The second speaker component is disposed at the casing, and faces towards a second direction which is different from the first direction. The sound-guiding board is a square plate body, located above the first speaker component, and is separated at a predetermined distance from the first speaker component.

15 Claims, 4 Drawing Sheets

(56) References Cited

U.S. PATENT DOCUMENTS

| | | | |
|---|---|---|---|
| 7,974,431 | B2 | 7/2011 | Saiki |
| 2007/0177742 | A1 | 8/2007 | Edgren et al. |

AUDIO OUTPUT DEVICE AND VIDEO/AUDIO OUTPUT DEVICE USING THE SAME

CROSS-REFERENCE TO RELATED APPLICATIONS

This application is a continuation of U.S. patent application Ser. No. 13/791,405, filed Mar. 8, 2013, which claims priority to Taiwanese Patent Application No. 101144049, filed on Nov. 23, 2012, the entire contents of which are hereby incorporated by reference.

BACKGROUND

Technical Field

The disclosure relates to an audio output device and a video/audio output device using the audio output device, and more particularly to an audio output device having two audio sources and a video/audio output device using the audio output device.

Related Art

The rapid development of semiconductor components or display devices contributes mostly to the rapid progress of the multimedia society. As for the display device, a cathode ray tube (CRT) type display device was always exclusively dominating the display market for outstanding display quality and economy thereof. However, the CRT type display device has problems of being too large in size as well as consuming too much energy. Also, the CRT type display device cannot satisfy requirements such as a high picture quality, low consumption of electric power, thin type and mass production, low-voltage driving, and a small volume. A Liquid Crystal Display (LCD) has great advantages for that, and is widely applied to various thin type televisions, video phones, camcorders, notebook computers, desktop monitors, tablet computers, and color projection televisions.

By taking the thin type television as an example, a speaker of the television inevitably develops towards the trend of the thin type in response to the design of the thin type television. However, once the volume of the speaker is reduced, the sound output quality of the speaker is also affected.

For example, to accommodate the shape of the speaker to the actual available space, lengths of the shape of the speaker on a horizontal axis and a vertical axis may be different, thereby leading to a distortion problem due to uneven amplitudes. Alternatively, since a vibration area of the speaker is small, the low-frequency extension of the speaker is insufficient, and a narrow range is caused. In addition, the thin type television in the prior art further adopts multiple groups of speakers with various frequencies, so as to achieve a stereophonic effect, and improve an overall sound quality of the television. However, due to the limitation of actual space, sound outputting directions of the speakers, with various frequencies, of the thin type television usually cannot be the same, so that the sounds of the television are separated, and the expected stereophonic effect is not achieved.

SUMMARY

An embodiment of the disclosure provides an audio output device which comprises a casing, a first speaker component, a second speaker component and a sound-guiding board. The first speaker component is a circular speaker, and is disposed at the casing. The first speaker component faces towards a first direction. The second speaker component, disposed at the casing, faces towards a second direction which is different from the first direction. The sound-guiding board is a square plate body, located above the first speaker component, and is separated at a predetermined distance from the first speaker component.

Another embodiment of the disclosure provides a video/audio output device which comprises a main body, a display screen and an audio output device. The main body has a first side and a second side opposite to each other. The display screen is located at the first side. The audio output device comprises a casing, a first speaker component, a second speaker component and a sound-guiding board. The casing has a first surface, a second surface and a third surface. The first surface and the third surface are opposite to each other, the second surface is connected between the first surface and the third surface. The casing is disposed at the main body, and the third surface faces towards the second side. The first speaker component is a circular speaker, and is disposed at the first surface of the casing. The first speaker component faces towards a first direction. The second speaker component is disposed at the second surface of the casing, and faces towards a second direction which is different from the first direction. The sound-guiding board is a square plate body, located above the first speaker component, and is separated at a predetermined distance from the first speaker component.

BRIEF DESCRIPTION OF THE DRAWINGS

The disclosure will become more fully understood from the detailed description given herein below for illustration only and thus does not limit the disclosure, wherein.

DETAILED DESCRIPTION

Figure 1:
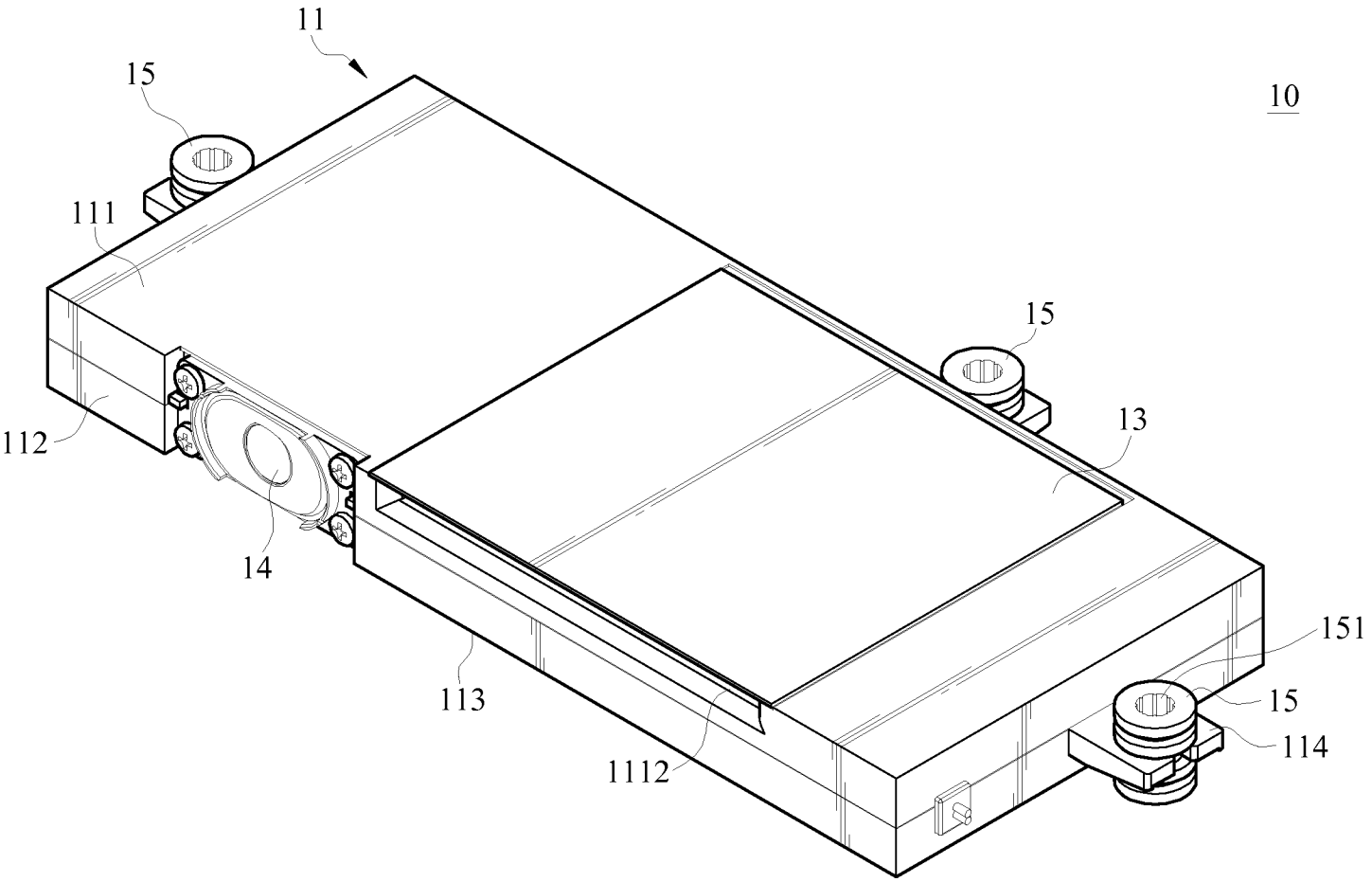
FIG. 1 is a schematic perspective view of an audio output device according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
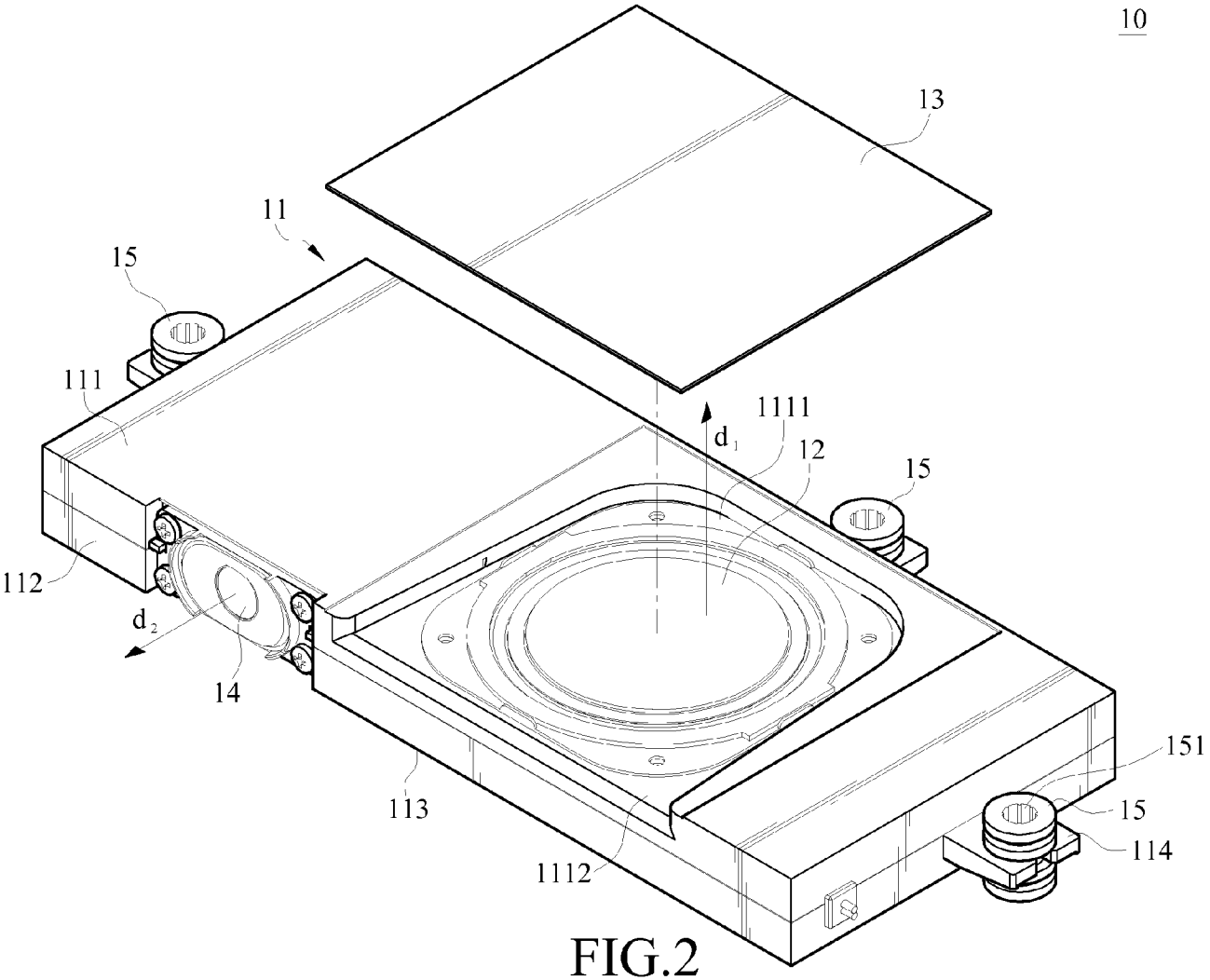
FIG. 2 is a partially-exploded view of the audio output device in FIG. 1.
Figure 3:
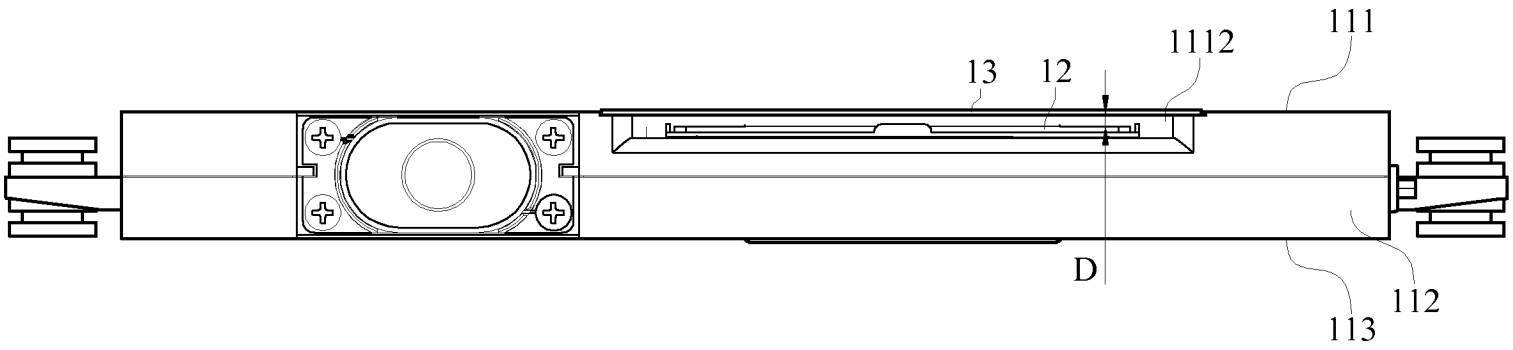
FIG. 3 is a side view of the audio output device in FIG. 1.

Referring to FIG. 1 to FIG. 3, FIG. 1 is a schematic perspective view of an audio output device according to an embodiment of the disclosure, FIG. 2 is a partially-exploded view of the audio output device in FIG. 1, and FIG. 3 is a side view of the audio output device in FIG. 1.

An audio output device 10 in this embodiment comprises a casing 11, a first speaker component 12, a second speaker component 14, and a sound-guiding board 13.

The casing 11 has a first surface 111, a second surface 112 and a third surface 113. The first surface 111 and the third surface 113 are opposite to each other. The second surface 112 is connected between the first surface 111 and the third surface 113. The second surface 112 is substantially perpendicular to the first surface 111 as well as to the third surface 113, and the area of the first surface 111 is greater than that of the second surface 112. The casing 11 has a recess 1111 which is formed inward from the first surface 111. The recess 1111 further has an opening 1112 located at the second surface 112.

The first speaker component 12 is a circular speaker, and the first speaker component 12 is disposed inside the recess 1111 of the first surface 111. The first speaker component 12 faces towards a first direction $d_1$. In this and some other embodiments, the first direction $d_1$ substantially faces towards a direction, the same as that of a normal vector of the first surface 111. In this and some other embodiments, the direction of the first speaker component 12 particularly refers to a direction in which a central axis of the first speaker component 12 extends out from the casing 11. Since the first speaker component 12 is a circular speaker, lengths of the shape of the first speaker component 12 on a horizontal axis and a vertical axis are the same, so that the sound from the first speaker component 12 has even amplitudes and is distortionless (namely, not distorted). In addition, since the circular speaker has a large vibration area, the first speaker component 12 has a good low-frequency extension and sound pressure, so as to serve as a full range frequency speaker of the audio output device 10.

The second speaker component 14 is disposed at the second surface 112 of the casing 11, and the second speaker component 14 faces towards a second direction $d_2$. In this and some other embodiments, the second direction $d_2$ substantially faces towards a same direction as that of a normal vector of the second surface 112, and therefore, the second direction $d_2$ is substantially perpendicular to the first direction $d_1$. In this and some other embodiments, the direction of the second speaker component 14 particularly refers to a direction in which a central axis, of the second speaker component 14, extends out from the casing 11. In this and some other embodiments, the second speaker component 14 is a speaker of various shapes. The volume of the first speaker component 12 is greater than the volume of the second speaker component 14, that is, the vibration area of the second speaker component 14 is smaller than that of the first speaker component 12, so that the second speaker component 14 is used as a high frequency speaker of the audio output device 10.

The sound-guiding board 13 is a square plate body, and in this and some other embodiments, the sound-guiding board 13 is made of metal, but the material is not limited thereto. The sound-guiding board 13 covers the recess 1111, so that the sound-guiding board 13 is located above the first speaker component 12, and the sound-guiding board 13 is separated at a predetermined distance D from the first speaker component 12. The predetermined distance D is required to be greater than the maximum stroke of the first speaker component 12, and the maximum stroke of the first speaker component 12 refers to a maximum amplitude of the first speaker component 12 when vibrating.

Furthermore, when the sound-guiding board 13 covers the recess 1111, the sound-guiding board 13 does not close the opening 1112 of the recess 1111, so that the opening 1112 is exposed outside as well as being between the sound-guiding board 13 and the casing 11. Both of the opening 1112 and the second speaker component 14 face towards the same direction, that is, the second direction $d_2$.

When the first speaker component 12 vibrates and generates a sound, sound waves thereof are blocked and reflected (namely, rebounded) by the sound-guiding board 13 and then are transmitted out through the opening 1112. In other words, the sound-guiding board 13 changes the transmitting direction of the sound waves, generated by the first speaker component 12, from the initial first direction $d_1$ to the second direction $d_2$, so that in this and some other embodiments, the final transmitting direction of the sound waves, generated by the first speaker component 12, is the same as that generated by the second speaker component 14. Therefore, in this and some other embodiments, the audio output device 10 presents a good stereophonic sound. In addition, since the sound-guiding board 13 is a square plate body, in this and some other embodiments, the sound waves of the first speaker component 12 are favorably centralized and reflected, so as to improve the audio source quality.

In addition, in this embodiment, multiple ears 114 are extended from the edge of the casing 11 of the audio output device 10, and multiple locking members 15 are adapted for being combined with the ears 114. Each of the locking members 15 has a through-hole 151 through which a locking element is threaded, for example, a screw, so that the audio output device 10 is locked and attached to various products. An actual application example where the audio output device 10 is applied to a product is introduced subsequently.

Figure 4:
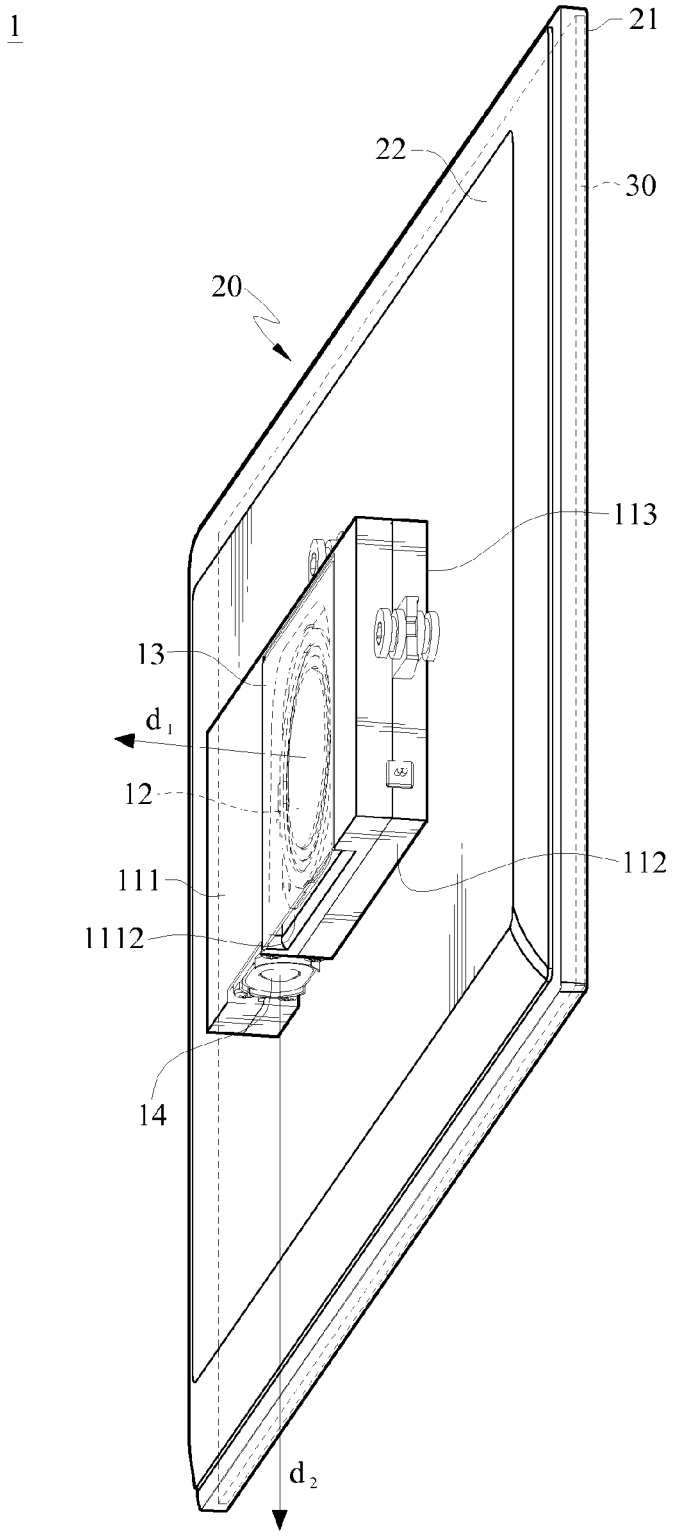
FIG. 4 is a schematic perspective view of a video/audio output device according to an embodiment of the disclosure.

Please refer to FIG. 4, which is a schematic perspective view of a video/audio output device according to an embodiment of the disclosure.

The audio output device 10 of the foregoing embodiment is applicable to a video/audio output device 1, and the video/audio output device 1 is a thin type display, but is not limited thereto.

The video/audio output device 1 comprises a main body 20, a display screen 30 and the audio output device 10. The main body 20 has a first side 21 and a second side 22 opposite to each other. The display screen 30 is located at the first side 21. A casing 11 of the audio output device 10 is disposed at the main body 20, and a third surface 113 of the casing 11 faces towards the second side 22. An opening 1112 and the second speaker component 14 both face towards a second direction $d_2$, and the second direction $d_2$ substantially faces downward in FIG. 4. In this and some other embodiments, the final sound output direction (i.e., the transmitting direction of the sound wave generated by the first speaker component 12), that is, the direction of the opening 1112 of the first speaker component 12 is the same as the sound output direction of the second speaker component 14, so that the video/audio output device 1 presents a good stereophonic sound.

For the audio output device and the video/audio output device using the audio output device, according to the foregoing embodiments, the first speaker component adopts the circular speaker, so as to have a large vibration area and improve the quality of the low-frequency sound and the sound pressure of the first speaker component. The sound-guiding board is a square plate body, thereby facilitating centralization of the sound waves of the first speaker component, and improving the audio source quality. Furthermore, with the sound-guiding board, the final sound output direction of the first speaker component is the same as the sound output direction of the second speaker component, so as to achieve a good stereophonic effect.

What is claimed is:

1. An audio output device, comprising:

a casing;

a first speaker component disposed at the casing and facing towards a first direction;

a second speaker component disposed at the casing, and facing towards a second direction, different from the first direction, wherein the volume of the first speaker component is greater than the volume of the second speaker component; and a sound-guiding board located above the first speaker component and separated at a predetermined distance from the first speaker component;

wherein the sound-guiding board covers the first speaker component, an opening exists between the sound guiding board and the casing, the second speaker being located beside a shorter edge of the opening, and the opening faces towards the second direction.

2. The audio output device according to claim 1, wherein the predetermined distance is greater than or equal to the maximum stroke of the first speaker component.

3. The audio output device according to claim 1, wherein the first direction is substantially perpendicular to the second direction.

4. The audio output device according to claim 1, wherein the casing has a first surface and a second surface, the first surface and the second surface are adjacent to each other, a recess is formed inward from the first surface and has the opening located at the second surface, the first speaker component is located inside the recess, the sound-guiding board covers the recess, and the second speaker component is located at the second surface.

5. An audio output device, comprising:

a casing;

a first speaker component being a full range frequency speaker, and disposed at the casing, and the first speaker component facing towards a first direction;

a second speaker component disposed at the casing, and facing towards a second direction, different from the first direction, wherein the volume of the first speaker component is greater than the volume of the second speaker component; and a sound-guiding board located above the first speaker component and separated at a predetermined distance from the first speaker component;

wherein the sound-guiding board covers the first speaker component, an opening exists between the sound guiding board and the casing, the second speaker being located beside a shorter edge of the opening, and the opening faces towards the second direction.

6. The audio output device according to claim 5, wherein the predetermined distance is greater than or equal to the maximum stroke of the first speaker component.

7. The audio output device according to claim 5, wherein the first direction is substantially perpendicular to the second direction.

8. The audio output device according to claim 5, wherein the casing has a first surface and a second surface, the first surface and the second surface are adjacent to each other, a recess is formed inward from the first surface and has the opening located at the second surface, the first speaker component is located inside the recess, the sound-guiding board covers the recess, and the second speaker component is located at the second surface.

9. An audio output device, comprising:

a casing;

a first speaker component being a full range frequency speaker, and disposed at the casing, and the first speaker component facing towards a first direction;

a second speaker component disposed at the casing, and facing towards a second direction, different from the first direction, wherein the volume of the first speaker component is greater than the volume of the second speaker component; and a sound-guiding board located above the first speaker component and separated at a predetermined distance from the first speaker component, wherein an area of the sound-guiding board is larger than an area of the first speaker component;

wherein the sound-guiding board covers the first speaker component, an opening exists between the sound guiding board and the casing, the second speaker being located beside a shorter edge of the opening, and the opening faces towards the second direction.

10. The audio output device according to claim 9, wherein the predetermined distance is greater than or equal to the maximum stroke of the first speaker component.

11. The audio output device according to claim 9, wherein the first direction is substantially perpendicular to the second direction.

12. The audio output device according to claim 9, wherein the casing has a first surface and a second surface, the first surface and the second surface are adjacent to each other, a recess is formed inward from the first surface and has the opening located at the second surface, the first speaker component is located inside the recess, the sound-guiding board covers the recess, and the second speaker component is located at the second surface.

13. A video/audio output device, comprising:

a main body having a first side and a second side opposite to each other;

a display screen located at the first side; and an audio output device comprising:

a casing having a first surface, a second surface and a third surface, the first surface and the third surface being opposite to each other, the second surface being connected between the first surface and the third surface, the casing being disposed at the main body, and the third surface facing towards the second side;

a first speaker component disposed at the first surface of the casing, and the first speaker component facing towards a first direction;

a second speaker component disposed at the second surface of the casing, and facing towards a second direction, different from the first direction, wherein the volume of the first speaker component is greater than the volume of the second speaker component; and a sound-guiding board located above the first speaker component, and separated at a predetermined distance from the first speaker component;

wherein the first surface has a recess, the first speaker component is located inside the recess, the sound-guiding board covers the recess, the recess has an opening located between the sound-guiding board and the casing, the second speaker locates beside one shorter edge of the opening, and the opening faces towards the second direction.

14. The video/audio output device according to claim 13, wherein the predetermined distance is greater than or equal to the maximum stroke of the first speaker component.

15. The video/audio output device according to claim 13, wherein the volume of the first speaker component is greater than the volume of the second speaker component, and the first direction is substantially perpendicular to the second direction.

* * * * *